US007461593B2

(12) United States Patent
Hu

(10) Patent No.: US 7,461,593 B2
(45) Date of Patent: Dec. 9, 2008

(54) METHOD AND APPARATUS FOR TOOL BIT MARKING

(75) Inventor: Max Hu, Taipei (TW)

(73) Assignee: Alltrade Tools LLC, Long Beach, CA (US)

( * ) Notice: Subject to any disclaimer, the term of this patent is extended or adjusted under 35 U.S.C. 154(b) by 359 days.

(21) Appl. No.: 11/228,115

(22) Filed: Sep. 16, 2005

(65) Prior Publication Data

US 2007/0062382 A1 Mar. 22, 2007

(51) Int. Cl.
*B31F 1/07* (2006.01)
*B31F 19/02* (2006.01)
*B44B 5/00* (2006.01)

(52) U.S. Cl. ..... 101/4; 101/5; 101/28; 101/32; 72/112; 72/125; 72/199; 72/214

(58) Field of Classification Search ..... 72/92–94, 72/112, 125, 199, 214; 101/4–5, 28, 32; 470/8

See application file for complete search history.

(56) References Cited

U.S. PATENT DOCUMENTS 3,691,806 A * 9/1972 Hanzawa ..... 72/92
4,546,630 A * 10/1985 Sakamura ..... 72/68
4,909,494 A * 3/1990 Meywald ..... 269/135
6,073,552 A * 6/2000 Cruse et al. ..... 101/32
6,145,361 A * 11/2000 Wengenroth ..... 72/72
6,244,089 B1 * 6/2001 Schoenau et al. ..... 72/108

* cited by examiner

*Primary Examiner*—Daniel J. Colilla
*Assistant Examiner*—Marissa L Ferguson-Samreth
(74) *Attorney, Agent, or Firm*—Steptoe & Johnson LLP

(57) ABSTRACT

A method and apparatus for imprinting text on items such as tools. The imprinting process involving employing a roll forging assembly including a large-sized roller plate and a multi-angle vise.

8 Claims, 1 Drawing Sheet

METHOD AND APPARATUS FOR TOOL BIT MARKING

BACKGROUND OF THE INVENTION

The present invention generally relates to marking and more particularly to marking tools and tool bits with identifying information.

Tools and other products are conventionally marked with product and identification information. For example, a product might be stamped with a trademark or logo for the purpose of identifying the source of the product. Moreover, items might be marked with product numbers or notice information such as patent numbers and copyright information.

In the area of tools, it has been found useful to mark items with product source information as well as size indicators. The user of sockets and other tool bits can benefit greatly from such markings. That is, rather than searching for the correct tool or attempting various sizes of unmarked tools, a person can rely on the size markings imprinted on an item to quickly identify the proper tool for the job.

It has been found, however, that tools and related items typically have size marking which are too small to see easily. This is especially the case in work areas lacking sufficient lighting.

The conventional process to make tools has also been found to have inherent problems and associated shortcomings. That is, typical tool marking processes involves the use of roll forging equipment. Conventional roll forging equipment includes a fixed angle tooling vise and a relatively small roller plate between which tools to be marked are advanced. The forces generated by the cooperation of the vise and roller plate result in creating a desired imprint in a tool. However, such imprinting can cause unwanted deformation in an item especially where there is an attempt to create larger markings. This problem can be exacerbated when employing a fixed angle vise.

Accordingly, there is a need for a method and apparatus for imprinting tools and other items with easily readable text which taking an approach to minimize deformation or damage to the items. The present invention satisfies these and other needs.

SUMMARY OF THE INVENTION

Briefly and in general terms, the present invention is directed towards a method and apparatus for imprinting items. More particularly, the present invention is concerned with marking tools with enlarged information.

In one aspect, tools such as sockets are contemplated to be marked with source information as well as enlarged size information. The approach to so marking tools necessarily involves avoiding undesired deformation to the item to be stamped.

In a particular aspect, the apparatus for stamping tools is roll forging equipment including a roller plate and a multi-angle vise. The roller plate is larger than conventional roller plates so that greater forces can be used to imprint tools. Additionally, the multi-angle vise provides a mechanism to imprint tools while avoiding undesired deformation.

In one embodiment, the present invention is adapted to print information on a socket device. The information is imprinted in a high visibility format so that text such as sizing information can be more easily read by a user. The approach also accomplishes avoiding damage to chrome plating of the socket.

In one specific approach, a socket is first formed using a cold forging process and then machined to size requirements and cleaned using ultra sonic vibration. The socket is then plated with chromium and nickel. Next, the socket is imprinted by rolling the text information into the plating at high pressure and thereafter cleaned.

Other features and advantages of the present invention will become apparent from the following detailed description, taken in conjunction with the accompanying drawings, which illustrate, by way of example, the principles of the invention.

DETAILED DESCRIPTION OF THE PREFERRED EMBODIMENTS

Turning now to the figures, which are provided for example and not by way of limitation, the present invention is embodied in a method and apparatus providing high visibility markings on an item. The shortcomings inherent in prior approaches are addressed by employing roll forging equipment configured to include a multi-angle vise cooperating with a relatively larger roller plate.

Figure 1:
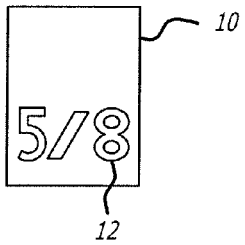
FIG. 1 is an elevational view, depicting one side of a tool imprinted with high visibility markings.
Figure 2:
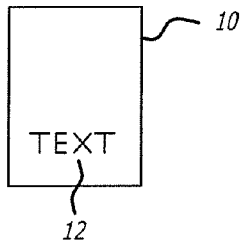
FIG. 2 is an elevational view, depicting another side of the tool of FIG. 1.

With reference to FIGS. 1 and 2, there is shown a tool marked with high visibility markings. Although a number of tools can be marked pursuant to the present invention, FIGS. 1 and 2 depict a socket marked with a ⅝" size indicator 12 as well as text 14. The text 14 can be a company name or logo or can be other identifying source language or a patent or copyright notice. The size indicator can be any relevant size information in any unit of measurement.

Figure 3:
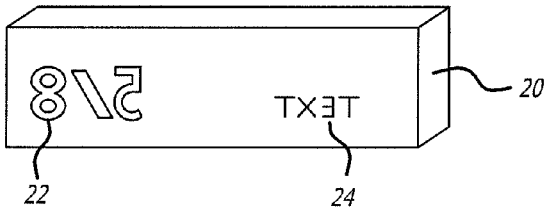
FIG. 3 is a perspective view, depicting a high visibility stamp.

FIG. 3 depicts a typical stamp tooling 20 which can be utilized to imprint the socket shown in FIGS. 1 and 2. The stamp tool 20 includes a raised high visibility size indicator 22 as well as raised letters pertaining to a particular text 24 which is desirable to stamp on a tool.

Figure 4:
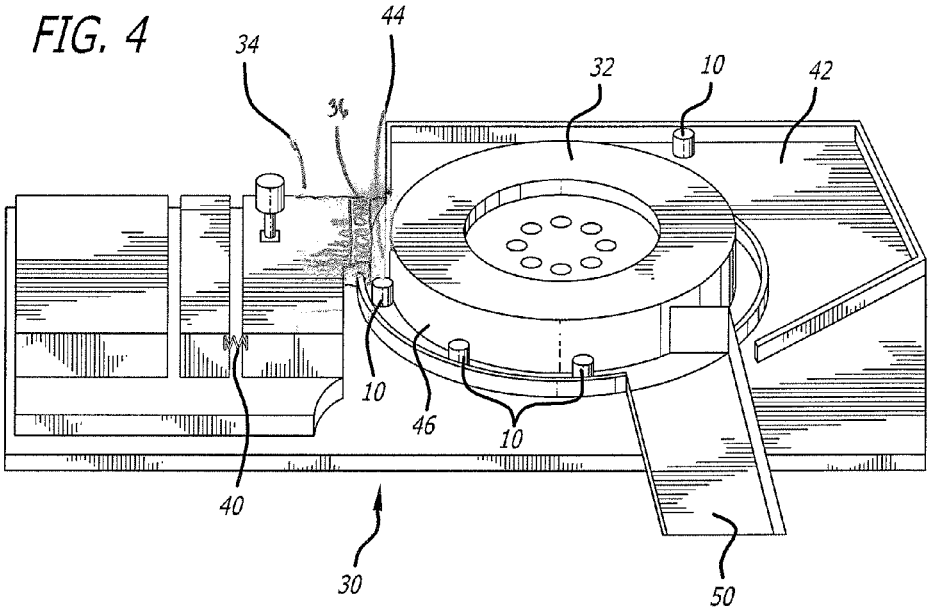
FIG. 4 is a perspective view, depicting one embodiment of an apparatus for imprinting tools.

Turning now to FIG. 4, there is shown one embodiment of a roll forging apparatus 30 of the present invention. Attached hereto in Appendix A are photos of a typical assembly of the present invention. The roll forging apparatus 30 is configured to make tools with high visibility and other text information. In general, the roll forging apparatus 30 includes a roller plate 32 and a multi-angle vise 34. The multi-angle vise 34 further includes stamp holding and retaining structure 36 which receives a stamp 20 to be used to mark a tool such as a socket 10.

The roller plate 32 of the present invention is larger in diameter than conventional roller plates. The motor (not shown) which drives the roller plate is also larger and has a greater power output than conventional roller plate motors. In this way, greater forces can be generated and sustained by the roller plate assembly 32 of the present invention.

The forces imparted in the stamping process are provided by the juxtaposition of the roller plate 32 and the multi-angle vise 34. The distance between the roller plate 32 and multi-angle vise 34 can be adjusted for a particular tool, the gap being used for smaller tools than for larger tools.

It has been recognized that a greater force is required to mark a tool with high visibility information such as tooling size 12 as opposed to other text information 14 (See FIGS. 1 and 2). Moreover, precise control of the stamping force is necessary to avoid deforming the tool being marked or damaging the plates thereof. Accordingly, the roll forging apparatus 30 of the present invention is provided with structure for spilling forces.

As shown in FIG. 4, the multi-angle vise 34 is equipped with at least one spring 40. The spring 40 is used to spill forces being generated between the roller plate 32 and the multi-angle vise 34. That is, the spring 40 provides the assembly with a recession feature such that there is greater recession associated with the stamping of text 14 as opposed to high visibility size marking 12, for example. Accordingly, unwanted deformation and/or damage to plating of a tool can be avoided.

In practice, a tool identified for stamping such as a socket, is formed using a cold forging process. The socket is then machined to size and cleaned ultrasonically. Next, the socket is plated with material such as chromium and nickel. Finally, the socket can be imprinted by roll forging.

Sockets 10 can be placed in a loading bay 42 configured adjacent and about the roller plate 32. The loading bay 42 is angled so that gravity facilitates a socket 10 to be advanced between the roller plate 32 and multi-angle vise 34.

The roller plate 32 has a ledge 44 associated therewith for receiving sockets 10 or other tools as well as a generally vertical and circular side wall 46. As the motor caused the roller plate 32 to rotate, sockets 10 or other tools are further advanced between and beyond the space between the roller plate 32 and the multi-angle vise 34. As a particular tool is advanced between the stamp mounting structure 36 and the roller plate 32, forces generated by the spatial relationship between the stamp 20 and the roller plate sidewall 46 result in generating an imprint in the tool. As stated, the precise spacing and spill force spring 40 provide the necessary force and recessive force required to mark the tool without undesirably deforming or damaging the tool.

Once the marked tool 10 passes beyond the stamping station of the roll forge apparatus 30, the ledge 44 of the roller plate 32 transports the tool 10 to an exit shoot 50. The exit shoot 50 can be angled to deliver the socket 10 to a storage bin for collection.

Therefore, the present invention provides a new and useful approach for roll forge stamping of tools with high visibility and other markings. By using a multi-angle vise including structures providing recession forces, varying forcing stamping can be accomplished.

Thus, it will be apparent from the foregoing that, while particular forms of the invention have been illustrated and described, various modifications can be made without the parting from the spirit and scope of the invention.

I claim:

1. An apparatus for imprinting tools, comprising: a base; a roller plate assembly mounted to the base, the roller plate assembly including a roller plate having ledge sized to accept a tool;

a multi-angle vise mounted to the base in a spaced relationship with the roller plate; and a stamp held by a vise;

wherein the spring is configured to provide the stamp with a first recession and a second recession, the first recession being less than the second recession.

2. The apparatus of claim 1, the multi-angle vise farther including a spring.

3. The apparatus of claim 2, wherein the spring is configured to absorb and transmit forces.

4. The apparatus of claim 1, wherein the stamp includes large sized projections and small sized projections.

5. The apparatus of claim 4, wherein the large sized projections are size indicators and the small sized projectors are text information.

6. The apparatus of claim 1, wherein the first recession corresponds to the large sized projectors.

7. The apparatus of claim 1, wherein the second recession corresponds to the small sized projectors.

8. A method for imprinting tools, comprising:

providing a roll forging apparatus including a roller plate assembly spaced from a multi angle vise, the roller plate assembly including a roller plate having a ledge sized to receive a tool;

activating the roller plate to facilitate rotation;

placing a tool on the ledge of the roller plate;

permitting the roller plate to advance the tool to a position between the multi-angle vise and the roller plate;

imprinting the tool with text; and providing the roll forging apparatus with a stamp and a spring in configuring the spring so that it provides the stamp with a first recession and a second recession.

* * * * *